US009598146B2

(12) United States Patent
Palmisano

(10) Patent No.: US 9,598,146 B2
(45) Date of Patent: Mar. 21, 2017

(54) STATIC BILGE PUMP

(71) Applicant: Doug Palmisano, Pompano Beach, FL (US)

(72) Inventor: Doug Palmisano, Pompano Beach, FL (US)

( * ) Notice: Subject to any disclaimer, the term of this patent is extended or adjusted under 35 U.S.C. 154(b) by 276 days.

(21) Appl. No.: 14/316,730

(22) Filed: Jun. 26, 2014

(65) Prior Publication Data

US 2015/0004008 A1 Jan. 1, 2015

Related U.S. Application Data

(60) Provisional application No. 61/839,847, filed on Jun. 26, 2013.

(51) Int. Cl.

| | |
|---|---|
| ***B63B 13/00*** | (2006.01) |
| ***F04F 1/06*** | (2006.01) |
| ***F04F 1/10*** | (2006.01) |
| ***F04F 1/18*** | (2006.01) |
| ***F04F 5/10*** | (2006.01) |

(52) U.S. Cl.

CPC ..... *B63B 13/00* (2013.01); *F04F 1/06* (2013.01); *F04F 1/10* (2013.01); *F04F 1/18* (2013.01); *F04F 5/10* (2013.01)

(58) Field of Classification Search

CPC ..... F04F 1/10; F04F 5/10; F04F 1/06; F04F 1/12; F04F 1/18; B63B 13/00; B63B 2705/00; B63H 21/38

USPC ..... 114/184, 185, 183; 417/151, 232

See application file for complete search history.

(56) References Cited

U.S. PATENT DOCUMENTS

| | | | | | |
|---|---|---|---|---|---|
| 322,374 | A * | 7/1885 | Haydn | B63B 13/00 | 114/185 |
| 349,497 | A * | 9/1886 | Haydn | B63B 13/00 | 114/185 |
| 1,578,621 | A * | 3/1926 | Wood | B63B 13/00 | 114/185 |
| 1,769,136 | A | 12/1928 | Hepburn | | |
| 2,018,687 | A * | 10/1935 | Sims | F04F 1/00 | 137/588 |
| 2,023,586 | A * | 12/1935 | Harrod | F04F 1/18 | 114/183 R |
| 2,120,858 | A * | 6/1938 | Davant | B63B 13/00 | 114/185 |
| 2,138,368 | A * | 11/1938 | Briant | B63B 13/00 | 114/185 |
| 2,138,369 | A * | 11/1938 | Briant | B63B 13/00 | 114/185 |
| 2,404,202 | A * | 7/1946 | Winslow | B63B 13/00 | 114/184 |
| 2,418,252 | A * | 4/1947 | Engle | B63B 13/00 | 114/185 |

(Continued)

*Primary Examiner* — Alexander Comley
(74) *Attorney, Agent, or Firm* — Allen F. Bennett; Bennett Intellectual Property

(57) ABSTRACT

A static bilge pump has an inlet tube, a body and one or more eductors. It may be attached to the back of a boat using bolts, or other means such that the inlet tube may be inserted into the drain at the bottom of the bilge of a boat. A siphon tube connected to the inlet tube hasn't ends that may be placed at the bottom of the bilge or moved about by an operator. The eductor's are streamlined to minimize drag and prevent blockage by debris and flotsam. Buttresses may extends between the body and the doctors to improve stability.

8 Claims, 6 Drawing Sheets

(56) References Cited

U.S. PATENT DOCUMENTS 2,444,615 A * 7/1948 Reinhardt ..... B63B 13/00 417/170
2,479,783 A * 8/1949 Sawyer ..... B63B 13/00 114/185
2,551,497 A * 5/1951 Lee ..... B63B 13/00 114/185
2,604,867 A * 7/1952 Frye ..... B63B 13/00 114/183 R
2,608,160 A * 8/1952 Moody ..... F04F 5/46 114/185
2,672,113 A * 3/1954 McCartney ..... B63B 13/00 114/185
2,711,151 A * 6/1955 Shoemaker ..... B63B 13/00 114/183 R
2,713,840 A * 7/1955 Stigall ..... B63B 13/00 114/185
2,771,052 A * 11/1956 Halverson ..... B63B 13/00 114/185
2,834,312 A * 5/1958 Baxter ..... B63B 13/00 114/185
2,866,431 A * 12/1958 Conover ..... B63B 13/00 114/185
2,929,347 A * 3/1960 Veltman ..... B63B 13/00 114/183 R
3,180,301 A * 4/1965 Keller ..... B63B 13/00 114/185
3,460,503 A * 8/1969 Chalmers ..... B63B 13/00 114/185
3,572,280 A * 3/1971 Monson ..... B63B 13/00 114/184
3,911,848 A * 10/1975 Brazier ..... B63B 13/00 114/185
4,217,846 A * 8/1980 Wight ..... B63B 13/00 114/185
4,667,616 A * 5/1987 Mahon ..... B63B 13/00 114/183 R
4,702,676 A * 10/1987 Westfall ..... F04F 5/463 417/179
4,850,908 A * 7/1989 Nakase ..... B63B 35/731 114/183 R
4,913,075 A * 4/1990 Rohr, Jr. ..... B63B 13/00 114/185
4,963,073 A * 10/1990 Tash ..... F04F 5/10 417/151
5,478,208 A * 12/1995 Kasai ..... C02F 7/00 4/491
6,663,451 B1 * 12/2003 Walczak ..... B63H 21/38 114/183 R
6,951,312 B2 10/2005 Casalmir et al.

* cited by examiner

STATIC BILGE PUMP

CROSS-REFERENCE TO RELATED APPLICATIONS

This application claims priority to U.S. Provisional Application Ser. No. 61/839,847 filed on Jun. 26, 2013, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

BACKGROUND OF THE INVENTION

Field of Endeavor:

The present invention relates to systems and devices for draining the bilge of a vessel in a body of water. More particularly, the invention relates to systems and devices having no moving parts and which may be used to drain a boat bilge.

Background Information

Since boats were first built, water collecting in the bilge, or the bottom of the interior of the hull, has been a problem. Numerous methods of been developed to remove bilge water from a boat. Automatic drains have been developed which open while a boat is in motion, allowing water to drain out. When the boat comes to a stop, the drain closes. However, because even when a boat is at rest, it is still subject to wind, current and other forces, such automatic drains often do not remain completely closed while a boat is at rest.

Another difficulty encountered with automatic drains is that they typically include components exterior to the hull. Prior to the advent of powered boats, this did not present a significant problem. However, many boats today are designed to operate at high speed. The hulls of most boats are streamlined to minimize water resistance and drag. Pumps, which include bulky devices on the exterior of the hull are thus not desirable.

Most boats today come with an automatic bilge pump. While these pumps are typically effective, they generally consist of an electric motor and some sort of pump mechanism. Because many boats are subjected to harsh conditions, it is not unusual for a bilge pump to become damaged or to cease functioning. Bilge pumps may require maintenance and may be inefficient. Further, pumping mechanisms generally require seals, rings, or other components made of rubber or other pliable substance. These substances often wear out when subjected to salt water. This further complicates maintenance of the system's.

In view of the foregoing, there is a need to provide a device and system for draining the bilge of a boat. It is therefore desirable to provide a device and system for draining the bilge of a boat that requires little maintenance, does not increase drag substantially, and is efficient.

BRIEF SUMMARY OF THE INVENTION

Accordingly, the primary object of the present invention is to provide a static bilge pump.

In greater detail, the invention provides a bilge pump having no moving parts and which removes water from the bilge without any application of force or energy. In one embodiment, a static bilge pump comprises an inlet tube, a body and at least one eductor.

In another embodiment the static bilge pump further comprises one or more of an inlet tube having an inlet duct and a drain conduit extending to a drain plug, a body having a frame and a conduit in fluid communication with the inlet duct, an eductor having a buttress, an eductor inlet in fluid communication with the conduit of the body, a nozzle in communication with an aperture, an annular vacuum chamber, an eduction chamber and an exhaust, a siphon hose attached to the inlet tube, plugs providing access to one or more of a drain, a conduit in the body, and an induction inlet.

In a further embodiment, the static bilge pump is attached to the stern of a boat.

In another embodiment a static bilge pump comprises an inlet tube housing a pump conduit and a drainage conduit, a body housing an internal conduit in fluid communication with the pump conduit, and at least one eductor in fluid communication with the internal conduit in the body. The static bilge pump is capable of being attached to the exterior of a boat hull and it removes water from a bilge of a boat when the boat is moving forward. The drainage conduit provides fluid communication between an aperture on the side of the inlet tube and a drainage outlet on the body, and is not in fluid communication with the pump conduit. The pump may have a plurality of eductors, and the body may have a frame. A siphon hose may be removably attached to the inlet tube.

In another embodiment, the static bilge pump may have one or more eductors comprising an eductor housing having an eduction chamber, an intake aperture, an intake nozzle providing fluid communication between the eduction chamber and the intake aperture, an eductor inlet providing fluid communication between an eduction port and the internal conduit, an annular vacuum chamber in fluid communication with the eductor port and eduction chamber and an exhaust port.

In another embodiment, the eductor housing is cylindrical, the intake aperture includes a screen to prevent debris from entering the eductor housing, and/or the body further has an internal frame. A siphon hose is removably attached to the inlet tube.

In another embodiment, the static bilge pump of claim 6 wherein the drainage conduit provides fluid communication between an aperture on the side of the inlet tube and a drainage outlet on the body, and is not in fluid communication with the pump conduit.

In another embodiment, a static bilge pump has an inlet tube housing a pump conduit and a drainage conduit, a body having a frame and housing an internal conduit in fluid communication with the pump conduit, and at least one eductor in fluid communication with the internal conduit in the body. The static bilge pump is capable of being attached to the exterior of a boat hull and removes water from a bilge of a boat when the boat is moving forward. The drainage conduit provides fluid communication between an aperture on the side of the inlet tube and a drainage outlet on the body, and is not in fluid communication with the pump conduit. The eductor comprises a cylindrical eductor housing having an eduction chamber, an intake aperture having a screen to prevent entry of debris, an intake nozzle providing fluid communication between the eduction chamber and the intake aperture, an eductor inlet providing fluid communication between an eduction port and the internal conduit, an annular vacuum chamber in fluid communication with the eductor port and eduction chamber and an exhaust port.

It is therefore an object of the present invention to provide a static bilge pump having no moving parts and which may be easily integrated with existing boat hulls.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
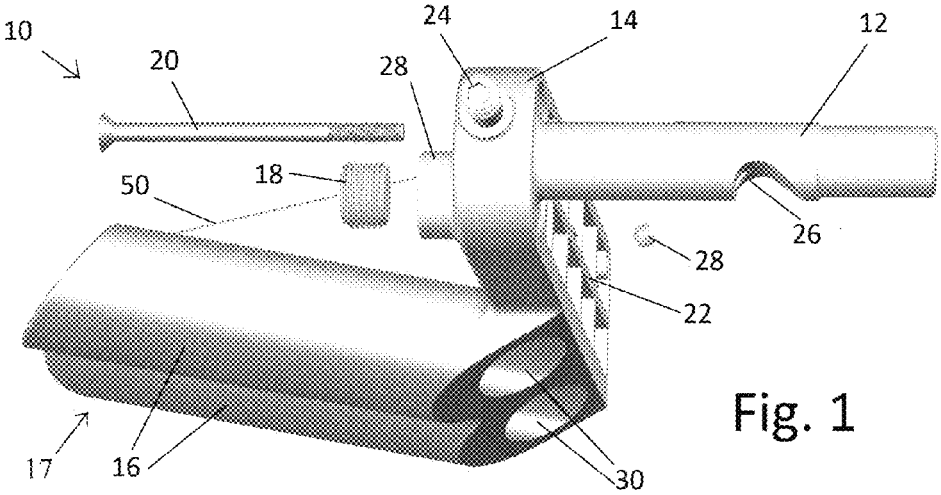
FIG. 1 is a perspective view of a static bilge pump in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a static bilge pump for watercraft requiring no moving parts. The static bilge pump may be attached to the hull over the drain hole commonly found at the back of the boat adjacent to the lowest point of the bilge. The static bilge pump may remove water from the bilge of a boat. When the boat is not submerged, the boat's original drain may still be utilized.

In the following description, the term "distal" generally refers to a direction away from a boat to which the static bilge pump is attached, and the term "proximal" generally refers to a direction toward the boat. Thus, "distal" could optionally be considered "back" or "rear" and "proximal" could optionally be considered "forward" or "front."

Figure 2:
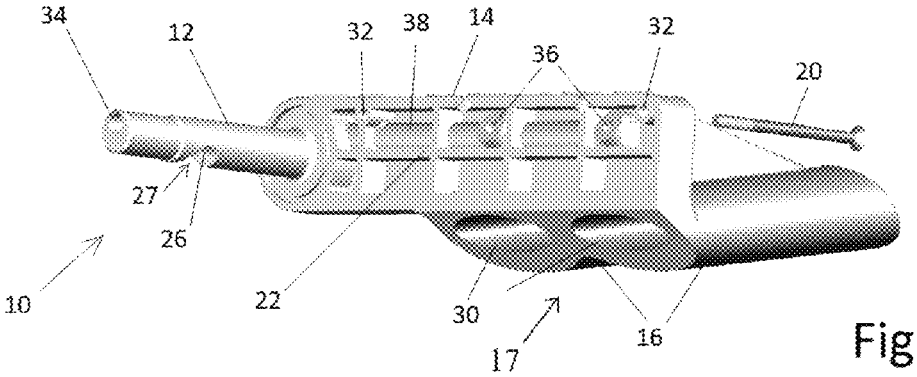
FIG. 2 is another perspective view of a static bilge pump in accordance with the principles of the invention.
Figure 3:
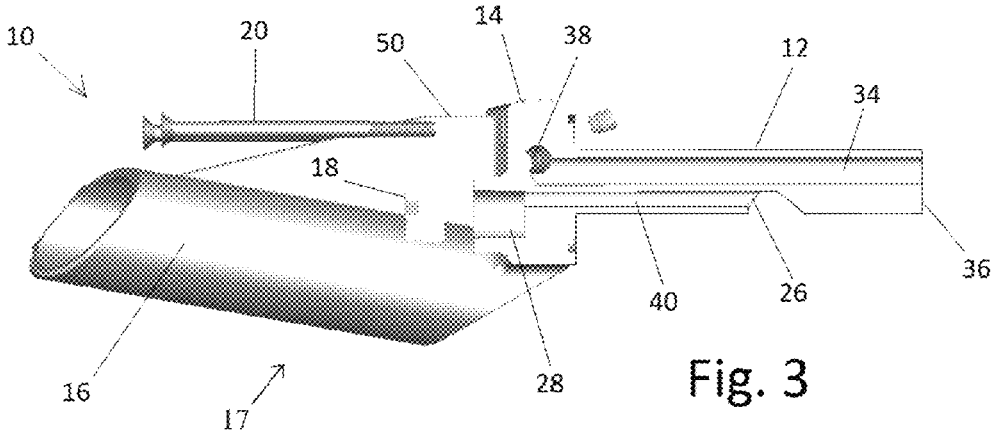
FIG. 3 is a a lateral cross-sectional view of an inlet tube of a static bilge pump in accordance with the principles of the invention.

Referring to FIGS. 1-6, the static bilge pump 10 may include an inlet tube 12, a body 14 and one or more eductors 17. The inlet tube 12 may house a drainage conduit 40 and a pump conduit 34, as shown in FIG. 3, that are not in fluid communication with each other. The drainage conduit 40 may extend from the drain aperture 26 to the drainage outlet 28. Drainage outlet 28 may be located on the distal end of the body 14 as shown in FIG. 1, or may optionally be located on the side of the body 14. Drainage outlet 28 may be sealed by inserting a drain plug 18. Fluid communication between the drain aperture 26 and the drainage outlet 28 may allow a boat to be drained while out of the water, in the same manner used in the absence of an attached static bilge pump. When a boat is in the water, it may be preferable to have the drain plug inserted into the drainage outlet.

An attachment mechanism may be used to affix the static bilge pump 10 to a boat's hull. In the embodiment shown in FIGS. 1-6, the attachment mechanism comprises a bolt 20 and bolt holes 32. Other attachment mechanisms suitable for attaching devices to the exterior of a boat hull may be used. For example, the inlet tube 12 may include an annular sleeve that may be inserted about the portion of the inlet tube that extends into the interior of the boat hull.

In this embodiment, the body 14 includes an interior frame 22 to provide strength and rigidity to the body 14. The body 14 may optionally be formed as a solid block. The body 14 may house an internal conduit 38 in fluid communication with the pump conduit 34 and the eductor inlets 46. In this embodiment, a conduit plug 24 may provide access to the internal conduit 38 which may be desirable for inspection, repair and/or manufacturing. Other plugs, for example inlet plugs 26 may also provide access to the internal conduit 38 and facilitate inspection, repair, cleaning and/or manufacturing.

In FIG. 2 conduit 38, bolt holes 32, suction duct 34 and nozzle access ports 36 may be seen. Drain aperture 26 may be located within a recess 27 on the side of the inlet tube 12. The opening to suction duct 34 may be located on the proximal end of inlet tube 12 and may be designed to accommodate removable fluid connection with a hose, pipe, tube or other device for moving fluids.

FIG. 3 shows a lateral cross-section of the inlet tube 12 of the static bilge pump 10. Within inlet tube 12, a drainage conduit 40 extends from the drainage aperture 26 to the drain 28, which may be sealed using drain plug 18. Suction conduit 34 extends the length of inlet tube 12 from the proximal end 36 to the internal conduit 38. Thus, pump conduit 34 provides fluid communication from the proximal end 36 of the inlet tube 12 to the internal conduit 38. The pump conduit 34 and the drainage conduit 40 may not be in fluid communication with each other. However, in some alternative embodiments, it may be desirable to optionally provide fluid communication between these or other conduits or valves for adjusting fluid communication between the various conduits.

Figure 4:
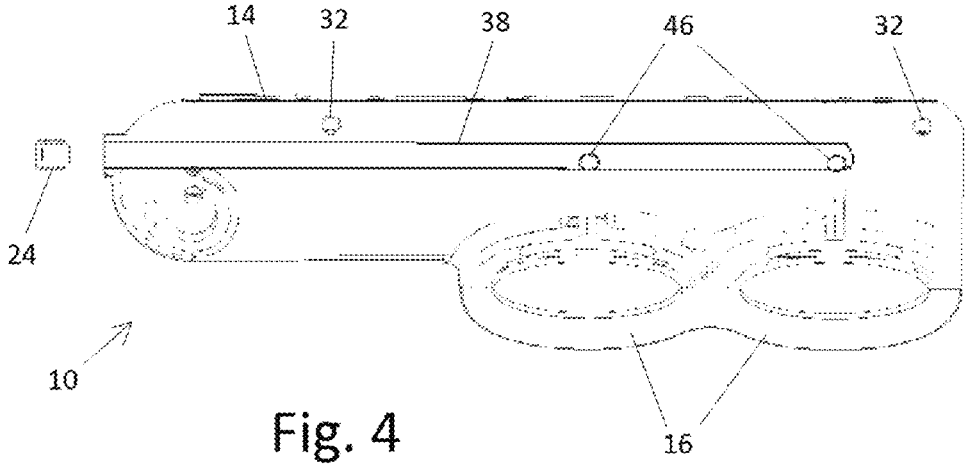
FIG. 4 is a transverse cross-sectional view of a body of a static bilge pump in accordance with the principles of the invention.

FIG. 4 shows a transverse cross-section of the body 14 of the static bilge pump 10. The body 14 includes the internal conduit 38 housed inside the body. The conduit plug 24 seals the end of the internal conduit 38 and also allows access to the conduit 38 from the exterior of the body 14. Bolt holes 32 may extend through body 14. As shown in FIG. 3, conduit 38 is in fluid communication with the suction duct 34. Conduit 38 is also in fluid communication with eductor inlets 46.

Figure 5:
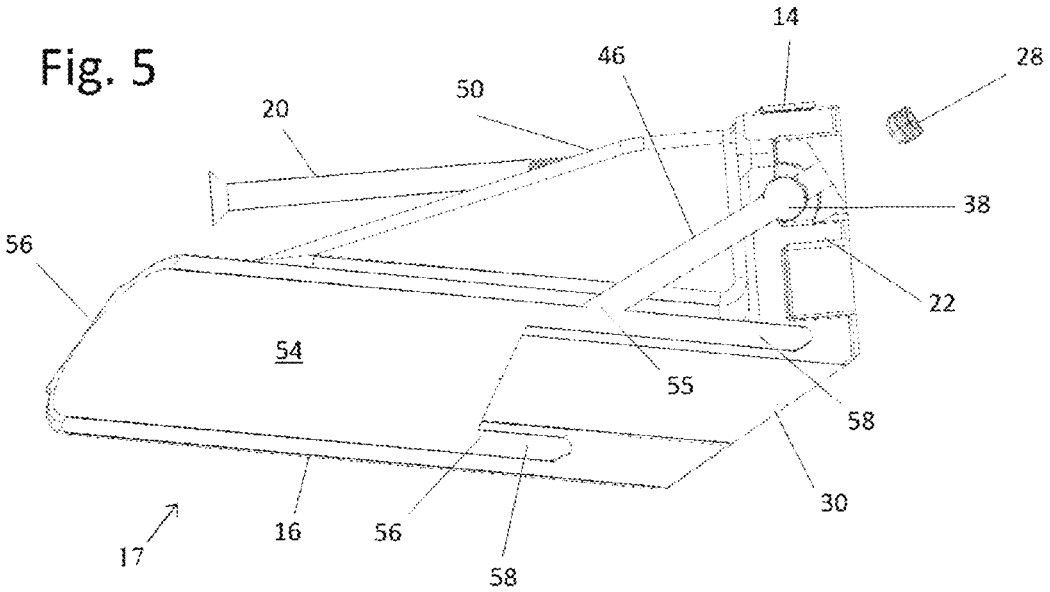
FIG. 5 is a lateral cross-sectional view showing the interior of an eductor of a static bilge pump in accordance with the principles of the invention.

Referring now to FIG. 5, a lateral cross-section of the static bilge pump 10 shows the interior of an eductor 17 and the body 14. Internal conduit 38 is in fluid communication with the eductor inlet 46. Plug 28 may be removed from the body 14 to access the interior of eductor inlet 46.

The eductor 17 may include several components. In this embodiment, the eductors include a cylindrical body housing the components of the eductor 17. The eductor inlet 46 may be in fluid communication with an annular vacuum chamber 58 by means of eduction port 55. Eduction inlet 46 may be integral to buttress 50. Buttress 50 extends from the body 14 to provide additional rigidity and support to the static bilge pump 10 and may be optional. The annular vacuum chamber 58 may surround a cylindrical motive nozzle 56, which may in fluid communication with intake aperture 30. When a boat is in motion, water may enter intake aperture 30 and enter eduction chamber 54 through intake nozzle 56. Water introduced into eduction chamber 54 through nozzle 56 creates a vacuum, courtesy of Bernoulli's Principle, within annular vacuum chamber 58. This creates suction at induction port 55. The suction, or negative pressure, applied to induction port 55 provides suction through eductor inlet 46, conduit 38 and pump conduit 34. Water and other items in eduction chamber 54 exit through exhaust port 56.

Figure 6:
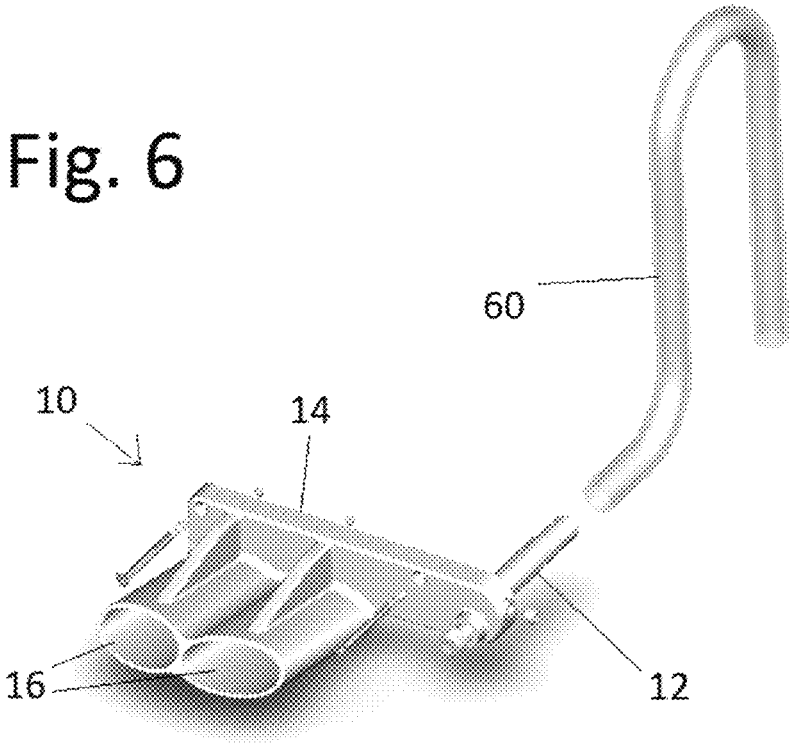
FIG. 6 is a perspective view of a static bilge pump with a siphon hose in accordance with the principles of the invention.

FIG. 6 shows the static bilge pump 10 with a siphon tube 60. The static bilge pump 10 may be placed on the exterior of a boat such that inlet tube 12 extends through a boats drain hole. Alternatively, a separate hole may be made in the hull of a boat through which the inlet tube may be extended. Body 14 may then be affixed to the exterior of the hull such that the front apertures of the eductors 16 are exposed to oncoming water when the boat is in motion. The inlet to 12 may then be attached to siphon 60. When in use, when a boat is traveling, the eductors 16 create vacuum suction which travels through the eductor inlets, the conduits and the inlet duct through siphon 60. The end 62 of siphon to 60 may be placed at or near the bottom of the bilge. Alternatively, siphon 60 may be flexible such that the end 62 of siphon 60 may be used as a vacuum hose such that a person in the boat may move the end 62 about to suck up and remove bilge water wherever it is located. The arched, "upside-down U" characteristic shape of the siphon 60 may prevent water from entering a bilge while the boat is at rest or in reverse.

Figure 7:
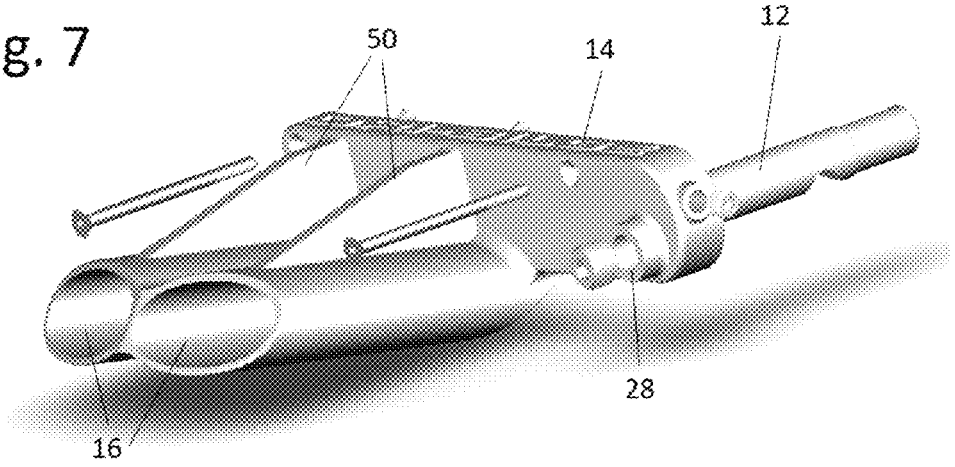
FIG. 7 is a perspective view of a static bilge pump in accordance with the principles of the invention.
Figure 8:
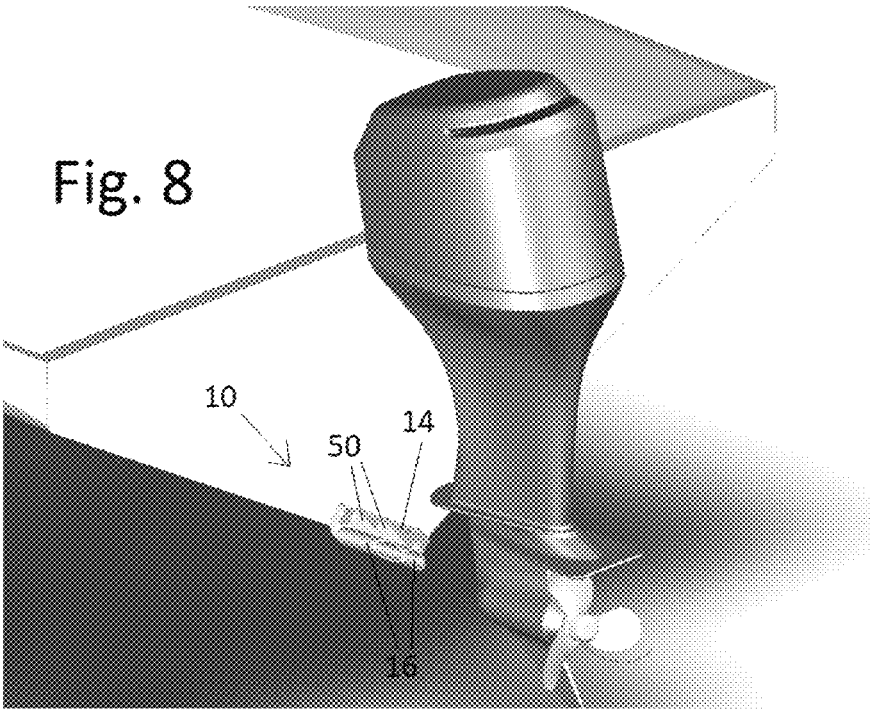
FIG. 8 is an environmental view of a static bilge pump with a siphon hose in accordance with the principles of the invention.

FIG. 7 shows a perspective view of the static bilge pump 10. The static bilge pump 10 may be attached to the stern of a boat but may also be attached to other objects. For example, a static bilge pump in accordance with the principles of the invention may include fins or other devices to facilitate proper orientation when dragged through water. Such an embodiment may be attached to the end of a hose and dragged by a boat. The motion through the water will generate suction and may provide an emergency back up alternative bilge pump for boats. The exhaust ports 56 of the eductors 17 may be swept back or swept together for hydrodynamic and/or aesthetic purposes. FIG. 8 shows a static bilge pump attached to the stern of a boat. In this Figure, the static pump is retrofit to a boat through its drain hole. The pump may have a very low profile, not significantly increasing drag.

Static bilge pump 10 may include two eductors 17 housed in cylindrical eductor bodies 16. It may be desirable to optionally utilize one eductor or 3 or more eductors, each having its own housing, which may be cylindrical or optionally parallelepiped or other shape. As shown in the Figures, the forward end of the inductors 17 are angled. This swept back design may minimize drag created by the eductor's and may also minimize the possibility of flotsam and jetsam lodging in and obstructing the apertures 30. The eductor's 17 may be made larger or smaller and may have a front end that is not swept back. It may also be desirable to provide simpler eductors having a smaller body or having no housing at all. Optionally, the inlet apertures of the eductors may include a grate or screen to prevent debris from entering the eductor housings.

Buttresses 50 extending between the body and the eductor housings 16 may provide additional stability to the static bilge pump 10. They also may house the induction inlets. It may be desirable to include additional buttresses or to use none at all. The inlet tube 12 of the invention incorporates both atypical drain as well as and inlet duct for the static bilge pump 10. It may be desirable to not include the simple drain aspects of the inlet tube 12.

Figure 9:
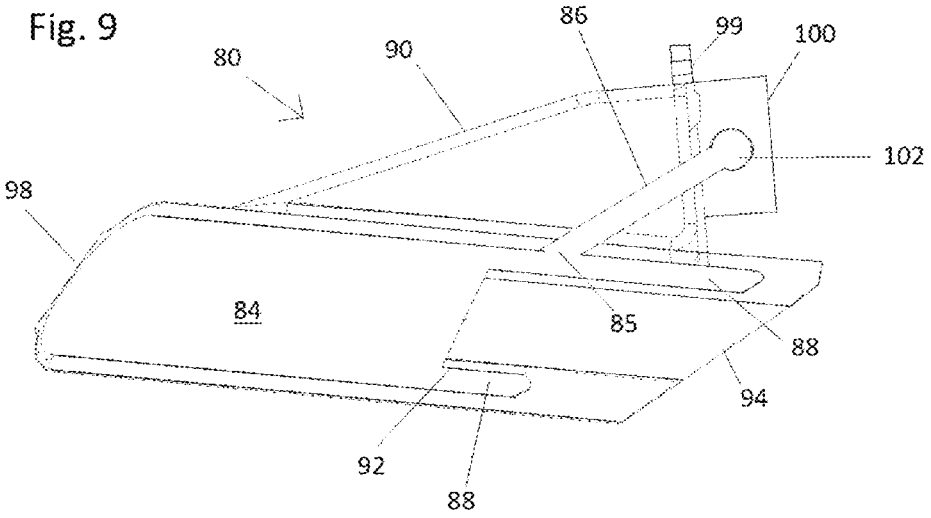
FIG. 9 is a lateral cross-sectional view of an alternative embodiment of an eductor of a static bilge pump in accordance with the principles of the invention.
Figure 10:
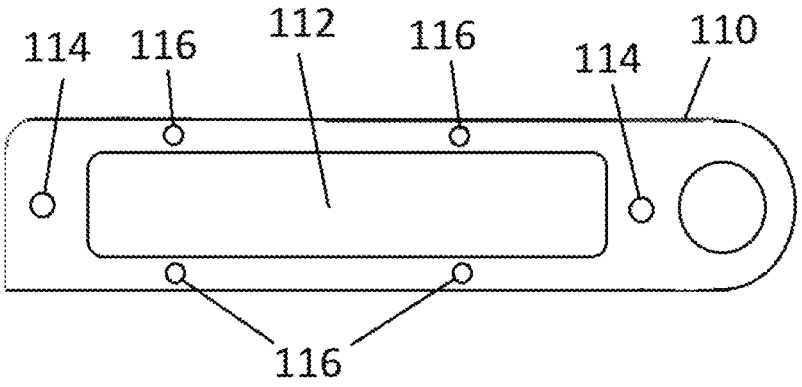
FIG. 10 front plan view of an alternative embodiment of an eductor of a static bilge pump in accordance with the principles of the invention.

FIGS. 9 and 10 show components of an alternative embodiment of the invention. FIG. 9 shows an eductor assembly 80 in accordance with the principles of the invention. An eductor inlet 86 may be in fluid communication with annular vacuum chamber 88 by means of eduction port 85. As with the embodiment of the invention shown in FIGS. 1-9, the eductor inlet 86 may be integral to a buttress 90. An annular vacuum chamber 58 may surround a cylindrical motive nozzle 92, which may be in fluid communication with aperture 94. When a boat is in motion, water may enter aperture 94 and may be ejected out of nozzle 92 and into eduction chamber 84. The movement of water through nozzle 92 and into eduction chamber 84 creates a vacuum within annular vacuum chamber 88. This in turn results in suction applied to eduction port 55 and through eductor inlet 86. Water and any other items in eduction chamber 84 may exit through exhaust port 98. Eductor assembly includes an integration block 100. Integration block 100 may include a conduit 102. A bolt hole 99 may be located just above integration block 110.

In FIG. 10 is shows an alternative embodiment of a body 110 in accordance with the principles of the invention. Body 110 includes an integration socket 112. Integration block 100 is sized to fit snugly with in integration socket well. Body 10 also includes bolt holes 114 for attaching the body 110 to a boat Hull. In this embodiment, body 110 also includes bolt holes 116. Bolt holes 116 may correspond to bolt holes 99 of the eductor assembly 80. Because bolt holes 116 may be located both above and below socket 112, and because the integration block 100 and socket 112 are bilaterally symmetric, and eductor assembly 80 may be integrated with a body 110. So that may be positioned either to the left or to the right of a boat hull's drain plug. It is not uncommon for various devices, such as trim tabs, sonar devices or other objects, to be installed close to a drain plug. If one or more devices are located adjacent to and left of a drain plug of a hole, it may not be possible to attach an eductor as shown in FIGS. 1-8 to the hull. The embodiment shown in FIGS. 9 and 10 allow for reversing and creating a mirror of the device as shown in FIG. 9. Making an eductor of the present invention ambidextrous, or capable of being flipped over to either side of a drain plug, facilitates an easier integration of the device into a boat hull.

Figure 11:
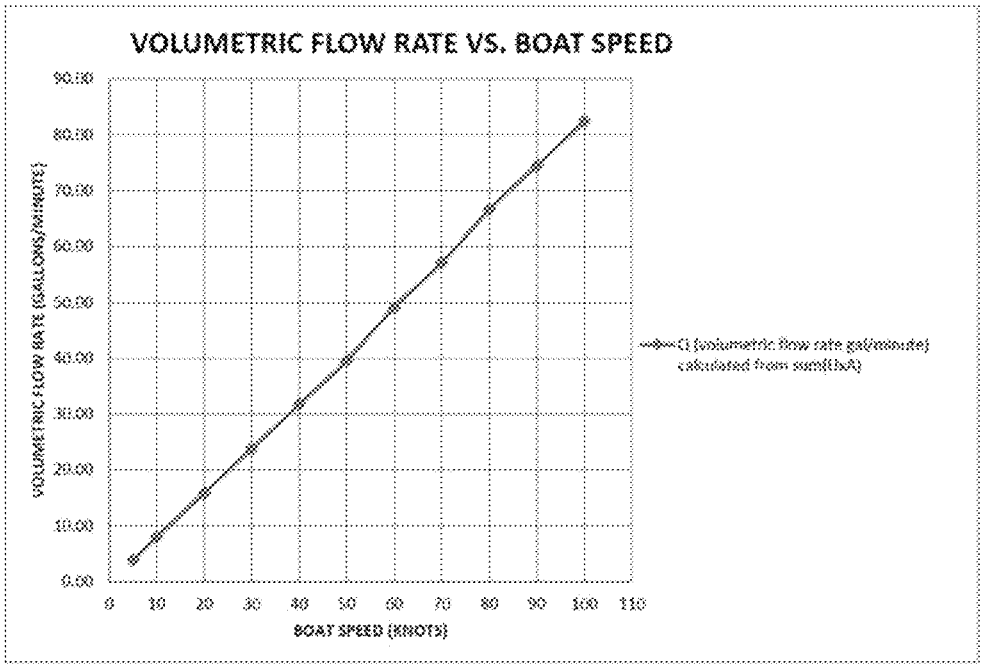
FIG. 11 is a graph showing the amount of gallons per minute a static bilge pump in accordance with the principles of the invention may be capable of pumping, as a function of speed of the boat.

FIG. 11 shows a graph of the amount of suction produced by the static bilge pump as a function of the speed of the boat to which it is attached. As may be seen, the static bilge pump, requiring no external power and having no moving parts, is capable of pumping 15 gallons per minute when a boat is traveling at only 20 miles per hour.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A static bilge pump comprising:

an inlet tube housing a pump conduit and a drainage conduit;

a body housing an internal conduit in fluid communication with the pump conduit;

at least one eductor in fluid communication with the internal conduit in the body;

wherein the static bilge pump is capable of being attached to an exterior of a boat hull;

wherein the static bilge pump removes water from a bilge of a boat when the boat is moving forward; and, wherein the drainage conduit provides fluid communication between an aperture on a side of the inlet tube and a drainage outlet on the body, and is not in fluid communication with the pump conduit.

2. The static bilge pump of claim 1 wherein the at least one eductor comprises a plurality of eductors.

3. The static bilge pump of claim 1 wherein the body further comprises an internal frame.

4. The static bilge pump of claim 1 further comprising a siphon hose removably attached to the inlet tube.

5. The static bilge pump of claim 1 wherein the at least one eductor comprises:

an eductor housing having an eduction chamber;

an intake aperture;

an intake nozzle providing fluid communication between the eduction chamber and the intake aperture;

an eductor inlet providing fluid communication between an eduction port and the internal conduit;

an annular vacuum chamber in fluid communication with the eductor port and eduction chamber; and an exhaust port.

6. The static bilge pump of claim 5 wherein the eductor housing is cylindrical.

7. The static bilge pump of claim 5 wherein the intake aperture includes a screen to prevent debris from entering the eductor housing.

8. A static bilge pump comprising:

an inlet tube housing a pump conduit and a drainage conduit;

a body having a frame and housing an internal conduit in fluid communication with the pump conduit;

at least one eductor in fluid communication with the internal conduit in the body;

wherein the static bilge pump is capable of being attached to an exterior of a boat hull;

wherein the static bilge pump removes water from a bilge of a boat when the boat is moving forward;

wherein the drainage conduit provides fluid communication between an aperture on a side of the inlet tube and a drainage outlet on the body, and is not in fluid communication with the pump conduit; and, wherein the at least one eductor comprises:

a cylindrical eductor housing having an eduction chamber;

an intake aperture having a screen to prevent entry of debris;

an intake nozzle providing fluid communication between the eduction chamber and the intake aperture;

an eductor inlet providing fluid communication between an eduction port and the internal conduit;

an annular vacuum chamber in fluid communication with the eductor port and eduction chamber; and an exhaust port.

* * * * *